US007743521B2

(12) United States Patent
O'Morrow, Sr.

(10) Patent No.: US 7,743,521 B2
(45) Date of Patent: Jun. 29, 2010

(54) PROFESSIONAL LAYOUT TOOL

(75) Inventor: Jonathan Mark O'Morrow, Sr., Brooks, GA (US)

(73) Assignee: Innovative Dynamics LLC, Brooks, GA (US)

( * ) Notice: Subject to any disclaimer, the term of this patent is extended or adjusted under 35 U.S.C. 154(b) by 52 days.

(21) Appl. No.: 12/240,506

(22) Filed: Sep. 29, 2008

(65) Prior Publication Data

US 2010/0077625 A1 Apr. 1, 2010

(51) Int. Cl.
*B43L 7/12* (2006.01)
*B43L 7/14* (2006.01)

(52) U.S. Cl. ..... 33/417; 33/471; 33/473

(58) Field of Classification Search ..... 33/417, 33/471, 473
See application file for complete search history.

(56) References Cited

U.S. PATENT DOCUMENTS

| | | | | |
|---|---|---|---|---|
| 1,821,103 | A * | 9/1931 | Luginbuhl | 33/417 |
| 2,178,021 | A * | 10/1939 | Meers | 33/419 |
| 3,373,496 | A * | 3/1968 | Nelson | 33/423 |
| 3,456,353 | A * | 7/1969 | Iams | 33/429 |
| 4,513,510 | A * | 4/1985 | Swanson | 33/419 |
| 4,712,307 | A * | 12/1987 | Kish | 33/421 |
| 4,742,619 | A * | 5/1988 | Swanson | 33/474 |
| 5,239,762 | A * | 8/1993 | Grizzell | 33/474 |
| 5,388,340 | A | 2/1995 | Marty | |
| 5,461,798 | A | 10/1995 | Ribeiro | |
| 5,575,074 | A | 11/1996 | Cottongim et al. | |
| 5,727,325 | A | 3/1998 | Mussell | |
| 6,049,990 | A | 4/2000 | Holland | |
| 6,122,834 | A | 9/2000 | Rester | |
| 6,725,555 | B1 * | 4/2004 | Moore | 33/423 |
| 6,839,974 | B1 * | 1/2005 | Hitchcock | 33/473 |
| 7,174,650 | B1 | 2/2007 | Marshall | |
| 7,228,636 | B1 | 6/2007 | Moore | |
| 7,398,601 | B2 * | 7/2008 | Morrell | 33/429 |

(Continued)

FOREIGN PATENT DOCUMENTS

GB 2170916 A * 8/1986

OTHER PUBLICATIONS

Swanson Tool Co., Framing Wizard: The Folding Framing Square (PDF brochure), date unknown, pp. 1-5, published by Swanson Tool Co., Frankfort, Illinois.

(Continued)

*Primary Examiner*—Christopher W Fulton
(74) *Attorney, Agent, or Firm*—Eric W. Cernyar

(57) ABSTRACT

An all-in-one combination layout tool is provided for marking center lines for spacing studs, marking rip lines, marking cut lines for roof rafters and staircase stringers, and other purposes. The tool comprises a rectangular base plate, an elongate locator bar with a rounded pivot corner, and two connectors to connect the locator bar to the base plate in a variety of configurations. The base plate includes multiple "pivot" points for pivotally connecting the locator bar, two strategically-placed arcuate slots for marking or making angle cuts, and two strategically placed parallel slots for configuring the tool to mark or make rip cuts. Angle markings are provided on two adjacent edges of the base plate, and 1/16-inch markings are provided on the opposite adjacent edges. The base plate is planar and has no enlarged flange or lip that would hinder its use in laying out staircase stringers.

20 Claims, 10 Drawing Sheets

U.S. PATENT DOCUMENTS

| | | | | |
|---|---|---|---|---|
| 7,437,826 | B1 * | 10/2008 | Harmon | 33/417 |
| 2002/0088130 | A1 | 7/2002 | Szumer | |
| 2003/0131487 | A1 | 7/2003 | Arent et al. | |
| 2004/0068883 | A1 | 4/2004 | Brooks | |
| 2004/0172846 | A1 | 9/2004 | McRae | |
| 2006/0032066 | A1 | 2/2006 | Nicholson | |
| 2006/0283033 | A1 | 12/2006 | Peterson | |
| 2007/0011896 | A1 | 1/2007 | Diaz et al. | |
| 2007/0017333 | A1 | 1/2007 | Hiland, Jr. | |
| 2008/0034599 | A1 | 2/2008 | Hamilton | |

OTHER PUBLICATIONS

Matt Weber, The Original Speed Square, date unknown, pp. 1-6, published by Extreme How-To, Birmingham, Alabama.

Swanson Tool Co., Big 12 Speed Square with patented Layout Bar, date unknown, pp. 1-3, published by Swanson Tool Co., Frankfort, Illinois.

Wikipedia, "Steel Square," date unknown, pp. 1-5, published by Wikipedia.org (publication location unknown).

* cited by examiner

PROFESSIONAL LAYOUT TOOL

FIELD OF THE INVENTION

This invention relates generally to layout tools, and more particularly to so-called "squaring" tools for marking cut lines on workpieces.

BACKGROUND OF THE INVENTION

There are several different types of layout tools that have been designed to assist carpenters in framing and construction of roof rafters, staircase stringers, spacing studs, marking rip lines, and the like. Carpenters often use framing squares for laying out staircase stringers and spacing studs. Perhaps the most famous tool for laying out roof rafters is the Swanson Speed Square offered by the Swanson Tool Co. of Frankfort, Ill. The speed square is shaped like a right-angle triangle with an enlarged lip or flange extending along one of the legs of the triangle.

The enlarged lip or flange of the speed square is a critical part of the speed square, for the speed square is positioned on a workpiece by pressing the speed square's lip against the workpiece straight edge. But the enlarged lip or flange makes the speed square, without an awkward accessory, unsuitable for laying out staircase stringers. Swanson Tool Co. offers a "Big 12 Speed Square" that combines an accessory that it refers to as a "layout bar" with a triangular speed square, for use in laying out staircase stringers. The layout bar, however, is not used to angularly align the speed square against a stringer. Rather, the layout bar simply adds a lip along the other "leg" of the right-angle triangle so that the speed square can be used to layout staircase stringers. Not only are two connectors required to connect the layout bar to the speed square, but also two separate "stop pegs" are required to configure the tool for laying out stringers. This particular product, in the inventor's opinion, is awkward, difficult, and time-consuming to use.

SUMMARY OF THE INVENTION

The inventor has developed an all-in-one combination layout tool that combines and extends the functions of a so-called "speed square" and a "framing square." It is easy to use and configure for different purposes, including marking center lines for spacing studs, marking rip lines, and marking cut lines for roof rafters and staircase stringers. It is also easier to mark accurate and consistent cut lines with this new layout tool than with prior art devices.

The tool comprises a rectangular base plate, an elongate locator bar with a rounded pivot corner, and just two connectors to connect the locator bar to the base plate in a variety of configurations. The base plate includes multiple "pivot" points for pivotally connecting the locator bar, two strategically-placed arcuate slots for marking or making angle cuts, and two strategically placed parallel slots for configuring the tool to mark or make rip cuts. Angle markings are provided on two adjacent edges of the base plate, and 1/16-inch markings are provided on the opposite adjacent edges. The base plate is planar and has no enlarged flange or lip that would hinder its use in laying out staircase stringers.

The locator bar is far more useful than the so-called "layout bar" of the "Big 12 Speed Square." For one thing, the locator bar can function by itself as a ruler, straight edge, or gauge. Second, the locator bar's "measuring edge" replaces the need for a "lip" on base plate. Either a rounded pivot corner, or the entire "measuring edge" of the locator bar is pressed against a workpiece straight edge in order to position the layout tool for marking or making cut lines. Third, the locator bar can be locked into a selected angular position for very accurate and stable positioning of the layout tool against a workpiece. When configured this way, the layout tool is so stable that it can be used directly as a saw guide - eliminating in many cases the need to mark a cut line. With the tool's locator bar locked into a fixed angular position with respect to the base plate, the tool can be placed against a workpiece while a circular saw is moved against an edge of the base plate, making an accurate angular cut. Fourth, the locator bar can be oriented to mark not only selected cut angles, but also staircase stringer "rise" and "run" cut lines. Fifth, the locator bar can be positioned parallel to the longitudinal edge of the base plate, for easy marking or cutting of "rip" lines. Sixth, the locator bar is longer than the either the width or length dimensions of the base plate. This allows the layout tool to be configured as either an 8-inch by 16-inch framing square or as a 12-inch by 16-inch framing square.

Furthermore, the rectangular shape of the base plate facilitates accurate angle markings and cut lines along four different edges, and more specifically, along two sets of parallel edges. As illustrated in the accompanying drawings, this configuration provides a number of advantages over prior art tools. One significant advantage is that it the tool does not have to be reconfigured to layout a staircase stringer. Based on the inventor's own experience, it dramatically reduces the time needed to layout staircase stringers—by as much as 90%. It also enables the tool to mark angle cuts from between 0 and 180 degrees, without flipping the tool.

Part of what makes the present invention so innovative and remarkable is its elegant simplicity. It comprises only a few different parts and is easy to use. But despite its simplicity, the present invention provides numerous advantages over more awkward prior art tools. Those of ordinary skill in the art will appreciate these and other improvements described further below in the detailed description and the accompanying drawings.

DETAILED DESCRIPTION

Figure 1:
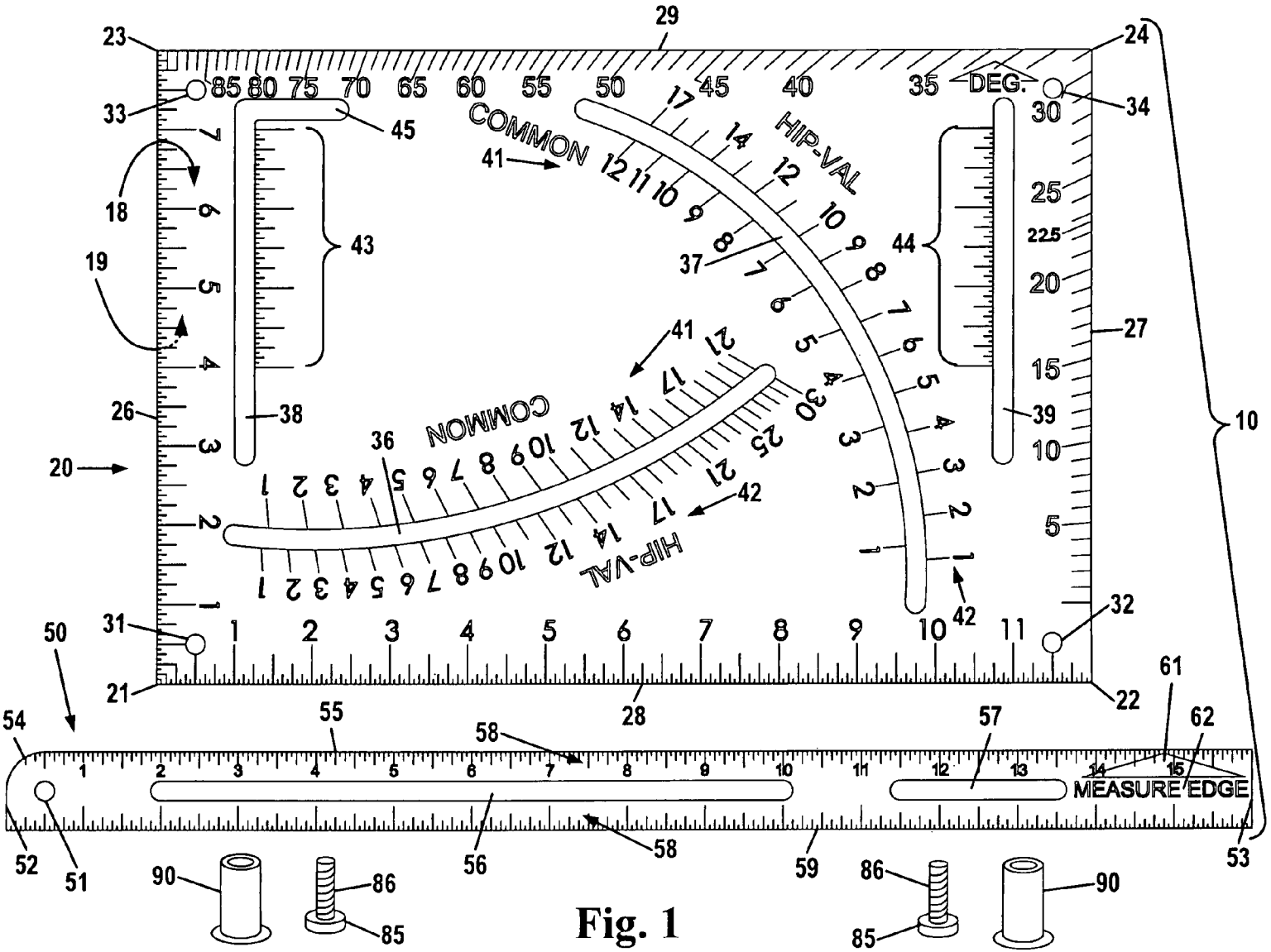
FIG. 1 is a drawing of one embodiment of the components of the layout tool.

FIG. 1 illustrates the components of one embodiment of the layout tool 10. Layout tool 10 comprises a rectangular base plate 20, an elongate locator bar 50, two shaft connectors 85 (for example, bolts), and two flange nuts 90. The base plate 20 and locator bar 50 are preferably made of a sturdy, lightweight material, such as aluminum or plastic, for ease of carrying. The locator bar 50 is operable to be pivotally and removably attached to the base plate 20 in a multitude of configurations. The different possible configurations, together with the strategic placement of angular and distance markings on the base plate 20 and the locator bar 50, serve a wide variety of layout needs.

The elongate locator bar 50 measures 1 inch wide by 16 inches long by 3/16 inches thick. It has a latitudinal (i.e., minor-axis) alignment edge 52, a right latitudinal edge 53, a straight measuring edge 55 (also referred to as a "layout edge"), and a longitudinal (i.e., major-axis) alignment edge 59 opposite the measuring edge 55. Regularly-spaced English-unit distance markings 58, the smallest of which are $1/16^{th}$ of an inch, are inscribed adjacent both the measuring edge 55 and the proximal longitudinal edge 59. The locator bar 50 includes an arrow 61 and the textual inscription 62 "measure edge" to assist users in the proper assembly and configuration of the layout tool 10.

The locator bar 50 includes a round pivot hole 51 located near the bar's latitudinal alignment edge 52 and centered on the ½-inch mark. The hole 51 is provided to receive a shaft connector 85 to pivotally attach the locator bar 50 to one of four holes 31-34 of the base plate 20. Accordingly, the hole 51 has a diameter slightly greater than the diameter of the shafts 86 of the connectors 85.

Figure 2:
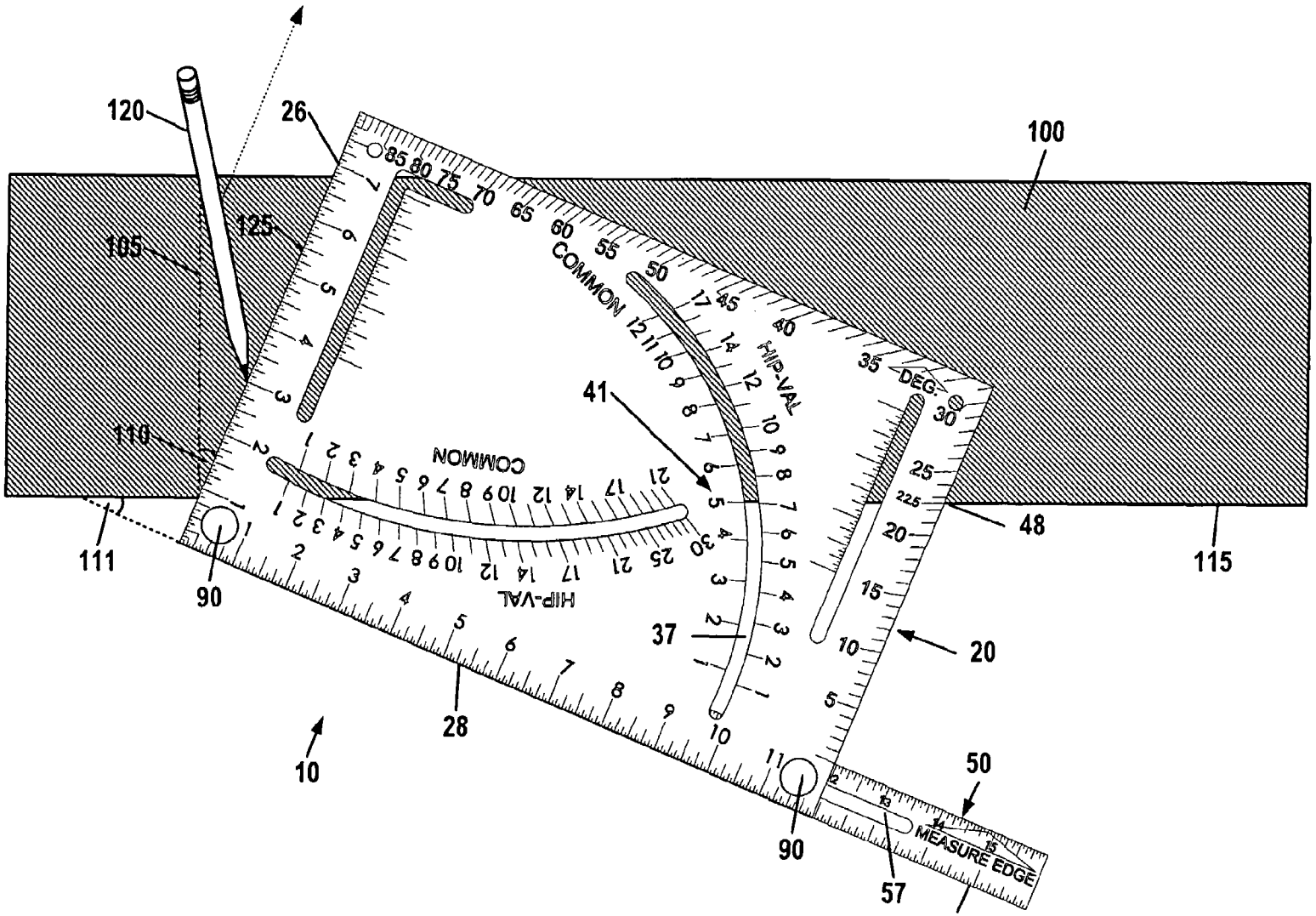
FIG. 2 illustrates the layout tool pivoted on a workpiece at a selected pivot angle to mark a cut line.

The locator bar 50 has four corners, all of which are right-angled except for rounded corner 54. Rounded corner 54 has a radius of ½ inch that extends in a clockwise direction from the midpoint of the latitudinal alignment edge 52 to the ½-inch mark on the measuring edge 55. When two connectors 85 secure the locator bar 50 to the rectangular base plate 20 as shown in FIG. 2, the rounded corner 54 provides a pivoting edge for pivoting the layout tool 10 against the straight edge 115 of a workpiece 100.

A first longitudinal slot 56 extends through the middle of the locator bar 50 from approximately from the 2-inch mark to the 10-inch mark. A second longitudinal slot 57 extends through the middle of the locator bar 50 from approximately from the 11½-inch mark to the 13½-inch mark. Both longitudinal slots 56 and 57 are provided to receive another shaft connector 85 to lock the locator bar 50, at a second point, to the base plate 20. Accordingly, both longitudinal slots 56 and 57 have a width slightly greater than the diameter of the shafts 86 of the connectors 85.

The base plate 20 measures 8 inches wide by 12 inches long by 3/16 inches thick. The base plate 20 has a front face 18, a back face 19, proximal left corner 21, a proximal right corner 22, a distal left corner 23, a distal right corner 24, a left latitudinal (i.e., minor-axis) edge 26, a right latitudinal edge 27, a proximal longitudinal (i.e., major-axis) edge 28, and a distal longitudinal edge 29.

Regularly-spaced English-unit distance markings, the smallest of which are $1/16^{th}$ of an inch, are inscribed adjacent the left latitudinal edge 26 and the proximal longitudinal edge 28. This perpendicular set of distance markings serves many construction purposes, most especially the layout of a staircase stringer (illustrated in FIG. 7). For staircase stringer configurations, a selected one of the distance markings along the left latitudinal edge 26 may serve as a "rise" length reference point, and a selected one of the distance markings along the proximal longitudinal edge 28 may serve as a "run" length reference point. Although not shown in the drawings, the base plate 20 may optionally have the inscriptions "rise" and "run" next to these corresponding sets of rise and run markings to illustrate this particular intended use.

Four round holes 31, 32, 33, and 34 are located near each of the corners 21-24 of the base plate 20. The holes 31, 32, 33, and 34, which are provided to receive a shaft connector 85 attaching the locator bar 50 to the base plate 20, serve as selectable pivot points for pivotally connecting the locator bar 20 to the base plate 20. Accordingly, the holes 31, 32, 33, and 34 have diameters slightly greater than the diameter of the shafts 86 of the connectors 85.

Angle markings, starting from 0 degrees at a point one inch above the proximal right corner 22 to about 31 degrees at the distal right corner 24, are inscribed along the right latitudinal edge 27. More angle markings, from about 31 degrees at the distal right corner 24 to 90 degrees at the distal left corner 23, are inscribed along the distal longitudinal edge 29. These angle markings are useful in marking cut lines when the layout tool 10 is pivoted about pivot point 31, as shown in FIGS. 2-5. Each of the angle markings is angularly oriented so that when the layout tool 10 is pivoted about pivot point 31 against the straight edge 115 of a workpiece 100, the angle marking corresponding to the selected pivot angle lines up with the workpiece edge 115.

Two elongated arcuate slots 36 and 37, each having common rafter slope markings 41 and hip-valley rafter slope markings 42, extend through the base plate 20. The markings represent the number of inches of rise per foot of run that an appropriately cut and assembled common rafter or hip-valley rafter is supposed to have. The markings facilitate orientations of the layout tool 10 to mark the appropriate rafter cuts. The arc of slot 37 has a 6-inch radius centered about 3 inches from the pivot point 31. The inside edge of slot 37 is concave with respect to pivot point 31 and is spaced from the pivot point 31 between about 6 inches at its closest point and about 9 inches at its farthest point.

Figure 7:
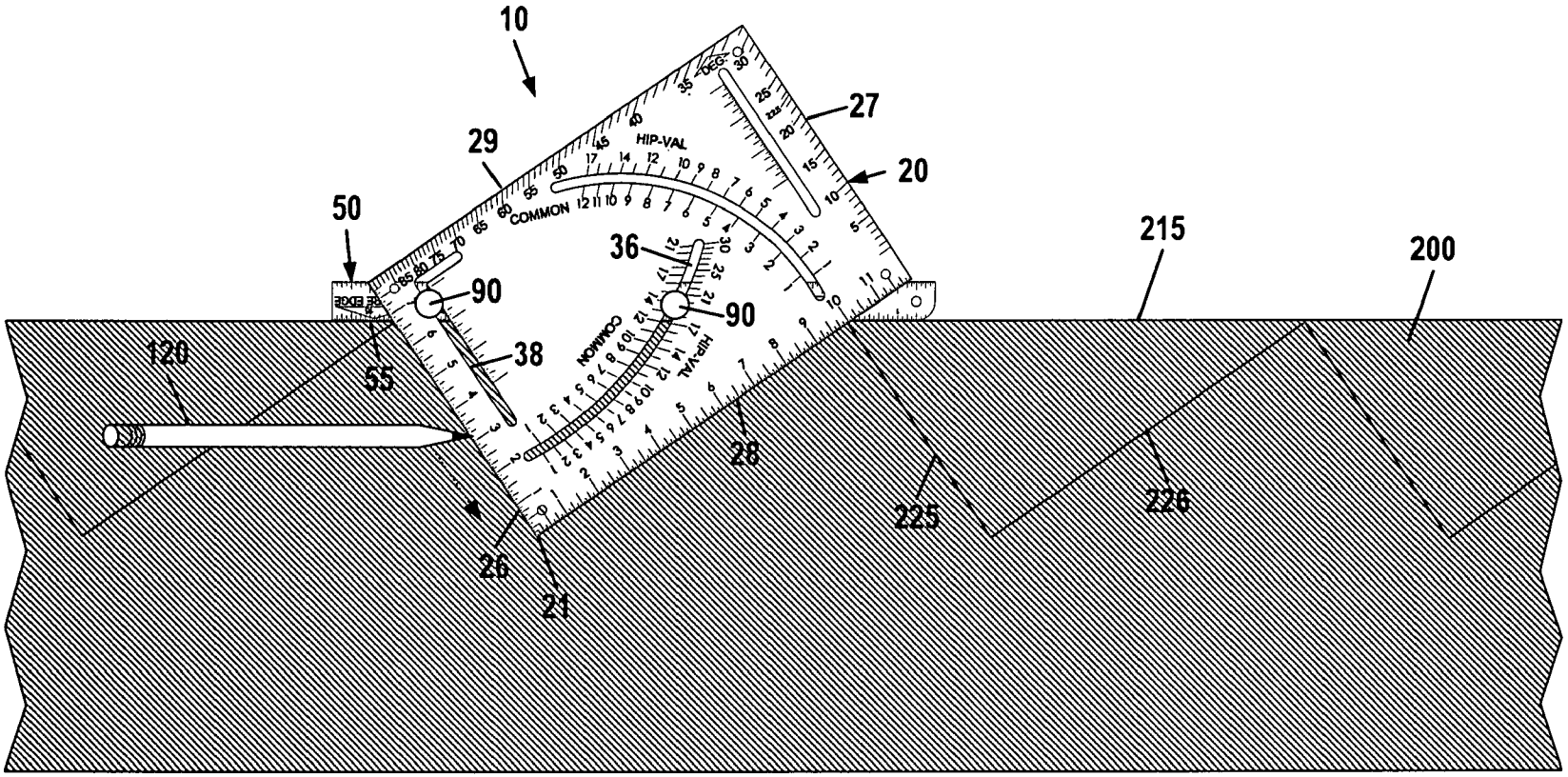
FIG. 7 illustrates the layout tool with its locator bar configured for laying out a staircase stringer.
Figure 8A:
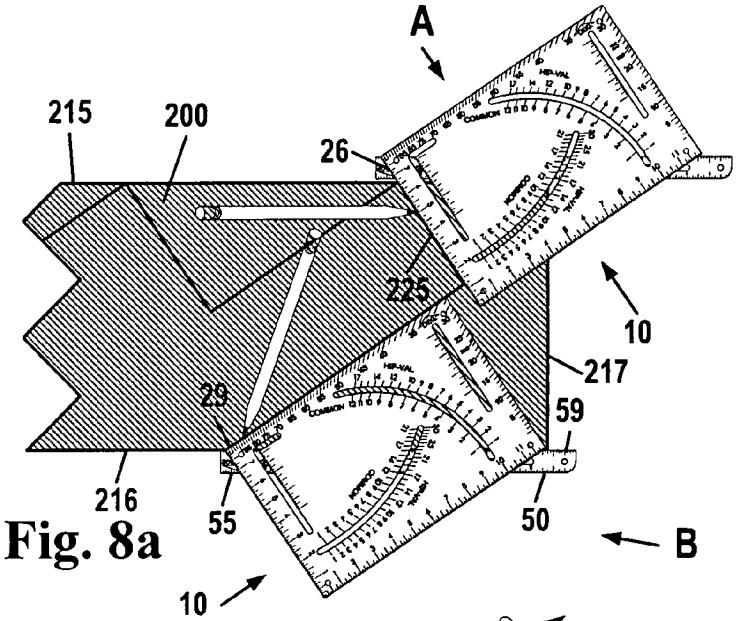
FIGS. 8*a* through 8*d* illustrate the layout tool of FIG. 7 rotated into positions for laying out the ends of the staircase stringer.
Figure 8B:
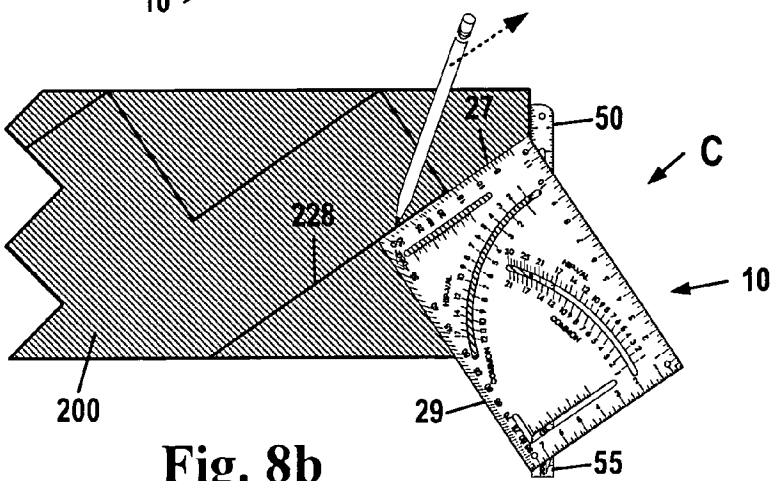
Figure 8C:
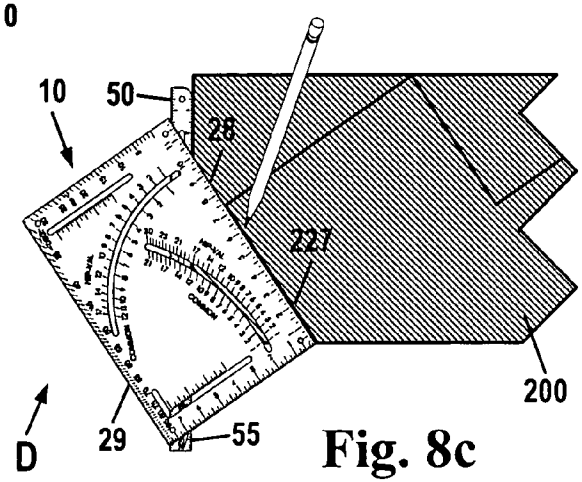
Figure 8D:
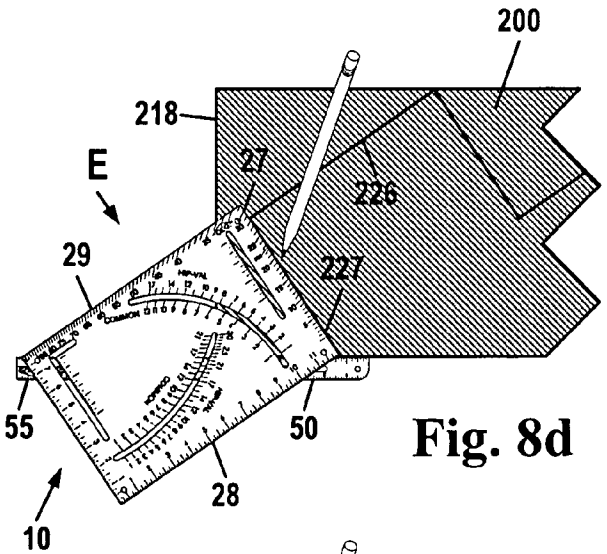

The arc of slot 36 has a 9-inch radius. The inside edge of slot 36 is concave with respect to pivot point 33 and is spaced from the pivot point 33 between about 9 inches at its closest point and about 10 inches at its farthest point. The outside edge of slot 36 is convex with respect to and extends fairly close to, and along a long portion of, the proximal longitudinal edge 28 of the base plate 20. The orientation of slot 36 is deliberate, for, as illustrated in FIG. 7, it facilitates staircase-stringer configurations of the locator bar 50 with respect to the base plate 20.

The arcuate slots 36 and 37 each have a width slightly greater than the diameter of the shafts 86 of connectors 85, so that the shafts 86 can be inserted up through the slots 56 and 57 of the locator bar 50 and up through the slots 36 and 37 of the base plate 20, and then engaged by the flange nuts 90, to lock the locator bar 50, at a selected orientation, against the base plate 20.

Figure 5:
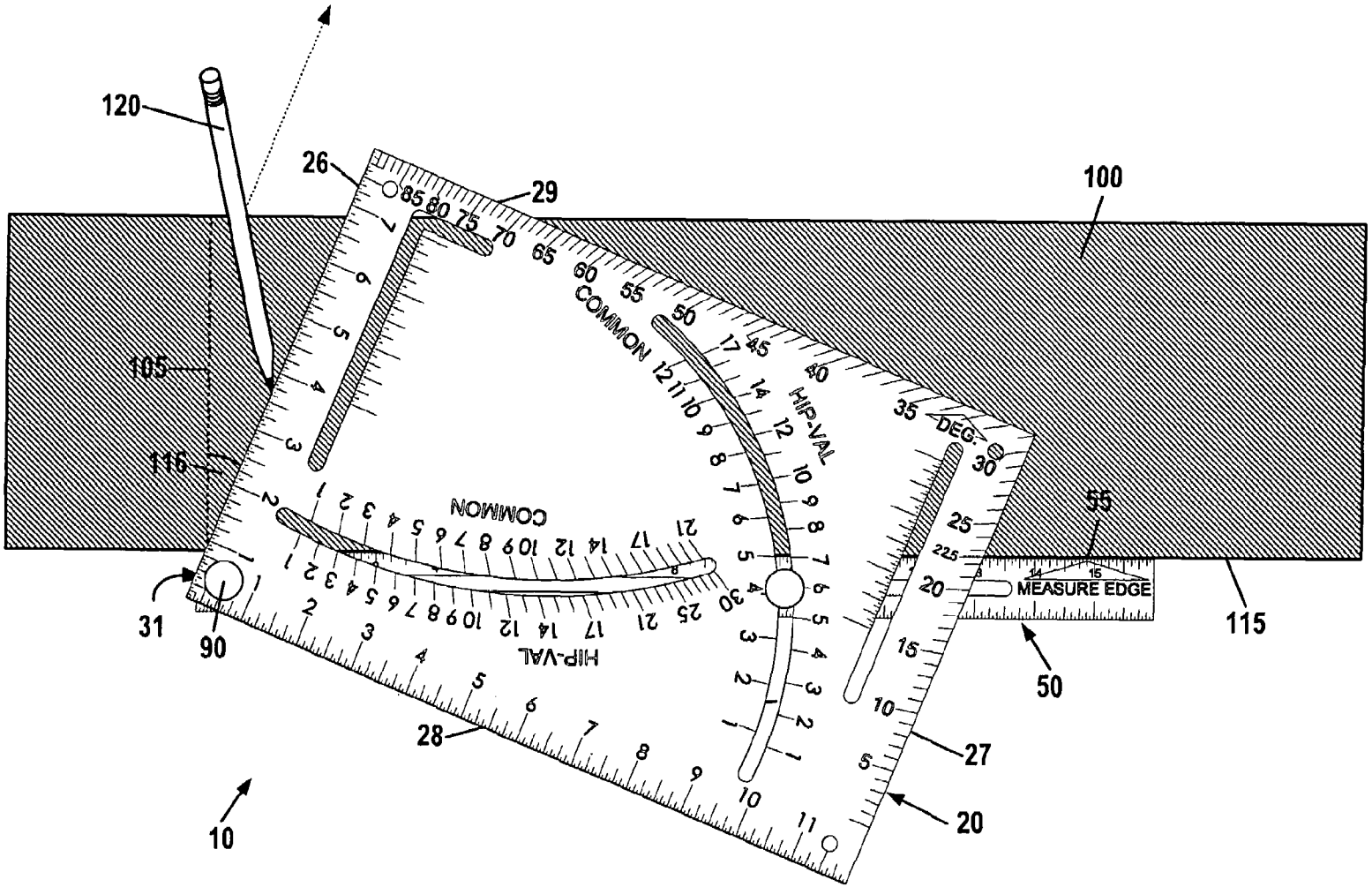
FIG. 5 illustrates the layout tool with its locator bar locked in position to facilitate more accurate angle markings.
Figure 6:
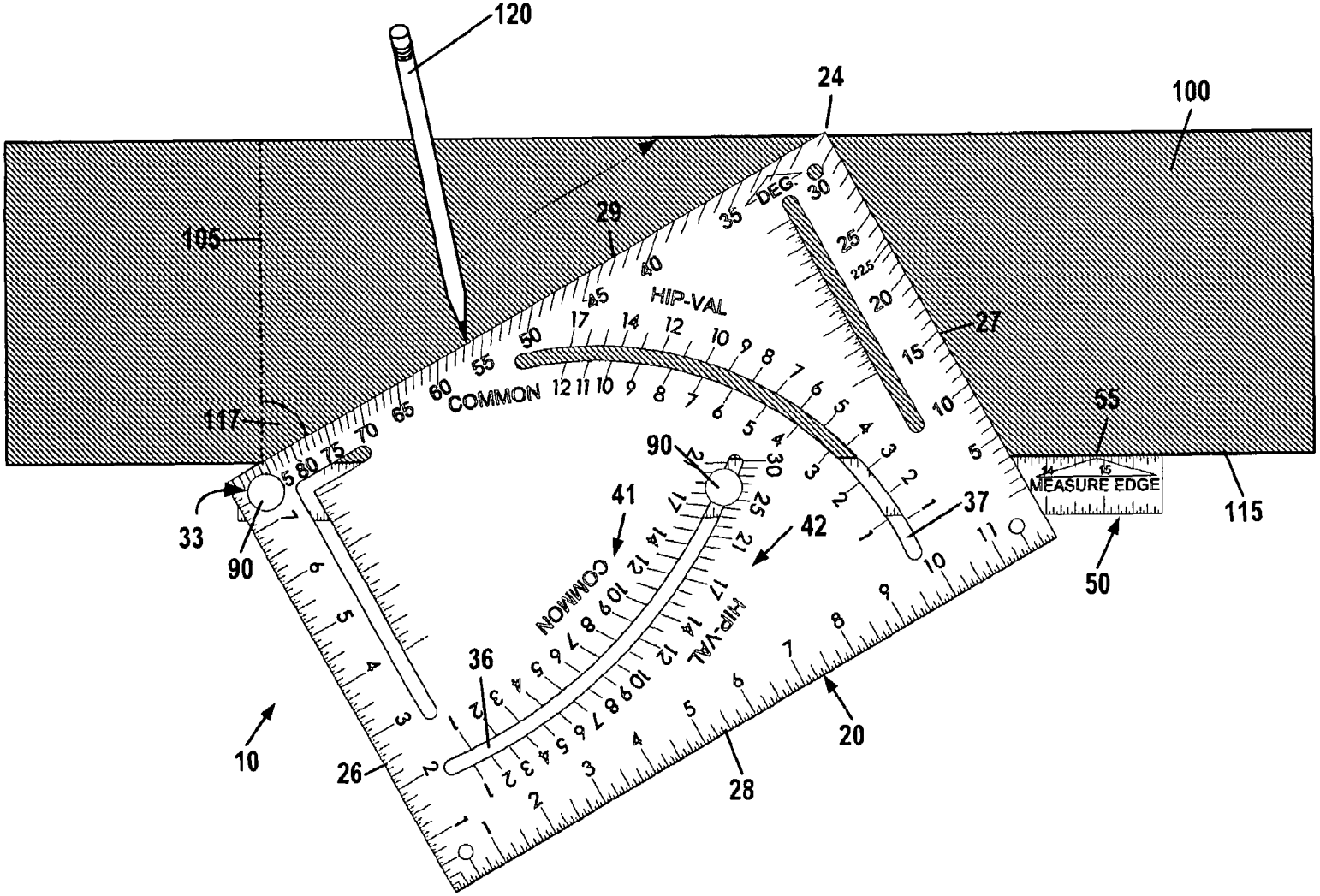
FIG. 6 illustrates the layout tool with its locator bar anchored at a second pivot point to facilitate accurate but larger angle markings.

The common rafter slope markings 41 and hip-valley rafter slope markings 42 are angularly oriented so that the locator bar 50, when affixed to the corresponding pivot point 31 or 33, can be pivoted so that it's measuring edge 55 lines up with a selected common rafter slope marking 41 or hip-valley rafter slope marking 42 (as shown in FIGS. 5 and 6). Also, when the layout tool 10 is pivoted about pivot point 31 against the straight edge 115 of a workpiece 100 as shown in FIG. 2, the appropriate common rafter slope marking 41 or hip-valley rafter slope marking 42 lines up with the workpiece edge 115.

The arc of slot 37 facilitates locking configurations of the locator bar 50 with respect to the base plate 20 (when anchored at hole 31) that range from about 3 degrees when the locator bar 50 is locked to the base plate 20 at the most proximal point available on the slot 37 to about 53 degrees when the locator bar 50 is locked to the base plate 20 at the most distal point available on the slot 37. The common rafter slope markings 41 of slot 37 extend from the value 1 to 12, which represents a range of rise/run slopes of between 1 inch of rise per foot of run to 12 inches of rise per foot of run. The hip-valley rafter slope markings 42 of slot 37 extend from 1 to 17, which represents a range of rise/run slopes of between 1 inch of rise per foot of run to 17 inches of rise per foot of run.

Slot 36 is provided for two purposes. The first purpose of slot 36 is to enable the locator bar 20 to be locked to the base plate 50 in a wide range of positions for laying out staircase stringers (see FIG. 7). The second purpose of slot 36 is to facilitate the marking of a wider array of angles than is possible with slot 37 (see FIG. 6). The arc of slot 36 facilitates locking configurations of the locator bar 50 with respect to the base plate 20 (when anchored at hole 33 as shown in FIG. 6) that range from about 4 degrees from the left latitudinal edge 26 when the locator bar 50 is locked to the base plate 20 at the left-most point available on the slot 36 to about 63 degrees when the locator bar 50 is locked to the base plate 20 at the right-most point available on the slot 36. To put it another way, the second elongated arcuate slot 36 facilitates a range of locked angular orientations of the locator bar 50 with respect to the base plate 20 that spans more than 45 degrees. The common rafter slope markings 41 of slot 36 extend from the value 1 to 21. The hip-valley rafter slope markings 42 of slot 37 extend from 1 to 30.

Figure 9:
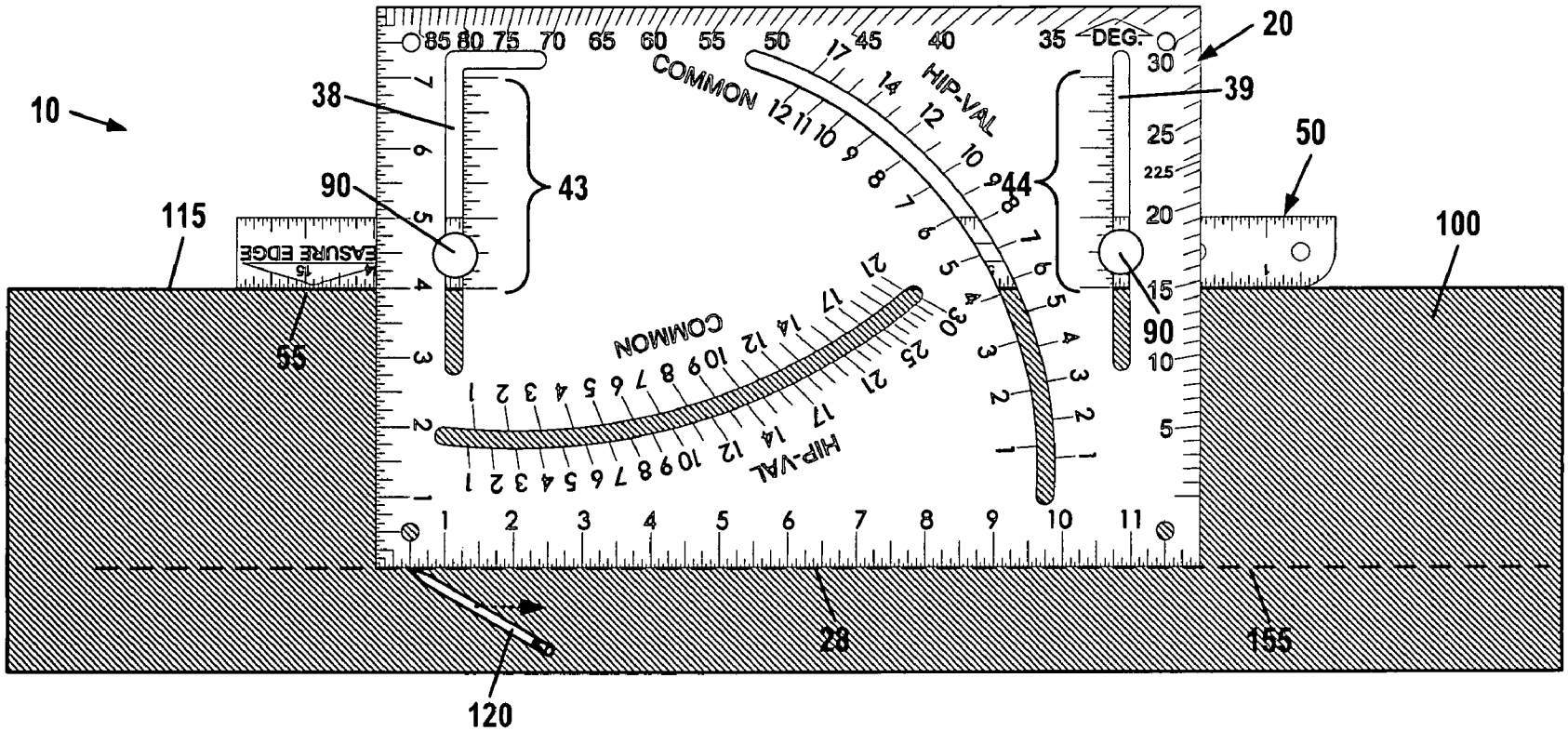
FIG. 9 illustrates the layout tool with its locator bar configured to mark rip lines.

A latitudinal L-slot 38 extends for about 4½ inches proximate and parallel to the left latitudinal edge 26. Another latitudinal straight slot 39 extends about 4½ inches proximate and parallel to the right latitudinal edge 27. The slots 38 and 39 each have a width slightly greater than the diameter of the shafts 86 of connectors 85, so that the shafts 86 can be inserted through the slots 56 and 57 of the locator bar 50 and through the slots 38 and 39 of the base plate 20, and then engaged by the flange nuts 90, to lock the locator bar 50 parallel to and at a selected distance from the proximal longitudinal edge 28 of the base plate 20. The slots 38 and 39 also have regularly spaced, coordinated alignment markings 43 and 44, the smallest of which are $1/16^{th}$ of an inch, inscribed against their inside edges. These coordinated alignment markings 43 and 44 facilitate the parallel positioning of the locator bar 50 against the base plate 20, as shown in FIG. 9, so that the locator tool 10 can be used to mark rip lines in a workpiece 100.

Latitudinal slot 38 includes a longitudinal, approximately 1-inch extension 45 for staircase stringer configurations of the layout tool 10. The longitudinal extension 45 enables the locator bar 50 to be positioned so that its measuring edge 55 intersects both the 8-inch distance mark on the left latitudinal edge 26 and the 12-inch distance mark on the proximal longitudinal edge 28 of the base plate 20.

All of the markings shown on the front face 18 of the base plate 20 of FIG. 1 are preferably reproduced, in mirror-image fashion, on the back face 19 of the base plate 20. For example, regularly-spaced distance and angle markings would be inscribed adjacent the same edges on the front face 18 as they are on the back face 19. Likewise, the markings shown on the front face of the locator bar 50 are preferably reproduced, in mirror-image fashion, on the back face of the locator bar 50.

FIG. 2 illustrates a pencil 120 being used with a particular configuration of the layout tool 10 to mark a line 125 for a rafter angle cut on a workpiece 100 such as a piece of lumber. The locator bar 50 is mounted on the underside of the base plate 20. A first shaft connector 85 (concealed from view, but with the corresponding flange nut 90 shown) has been inserted, from below, first through the hole 51 of the locator bar 50 and second through the hole 31 of the base plate 20, and then engaged by a hand-tightened flange nut 90. A second shaft connector 85 (also concealed from view, but with the corresponding flange nut 90 shown) has been inserted, from below, first through the slot 57 of the locator bar 50 and second through the hole 32 of the base plate 20, and engaged by a hand-tightened flange nut 90.

In this position, the proximal longitudinal edge 28 of the base plate 20 is aligned with the proximal longitudinal edge 59 of the locator bar 50. Also, the latitudinal alignment edge 52 of the locator bar 50 is aligned with a left latitudinal edge 26 of the base plate 20.

In FIG. 2, the layout tool 10 is positioned over the face of the workpiece 100, with the curved, rounded corner 54 (hidden from view in FIG. 2) of the locator bar 50 positioned against the straight edge 115 of the workpiece 100. FIG. 2 also illustrates how the slot 37 exposes the workpiece straight edge 115 to view. The layout tool 10 has been pivoted about the rounded corner 54 so that the common rafter slope marking 41 of the arcuate slot 37 having a value of "5" approximately lines up with the straight edge 115 of the workpiece 100. As is well known in the industry, the common rafter slope value "5" corresponds to a "rise" of 5 inches per foot of "run." (This also corresponds to an angle of about 22.62 degrees). Likewise, the angle marking 48 having a value of "22.5" degrees approximately lines up with the workpiece straight edge 115.

With the layout tool 10 so positioned on and against the workpiece 100, the left latitudinal edge 26 of the base plate 50 provides a guide for marking a line 125 or moving a saw at an angle corresponding to a selected common rafter marking 41 of the arcuate slot 37. Namely, the angle 110 between the left latitudinal edge 26 and a perpendicular 105 to the workpiece straight edge 115 is about 22.5 degrees, which equates very approximately to a rise of 5 inches per every foot of run. Likewise, the angle 111 between the proximal longitudinal edge 28 and the workpiece straight edge 115 is about 22.5 degrees.

Figure 3:
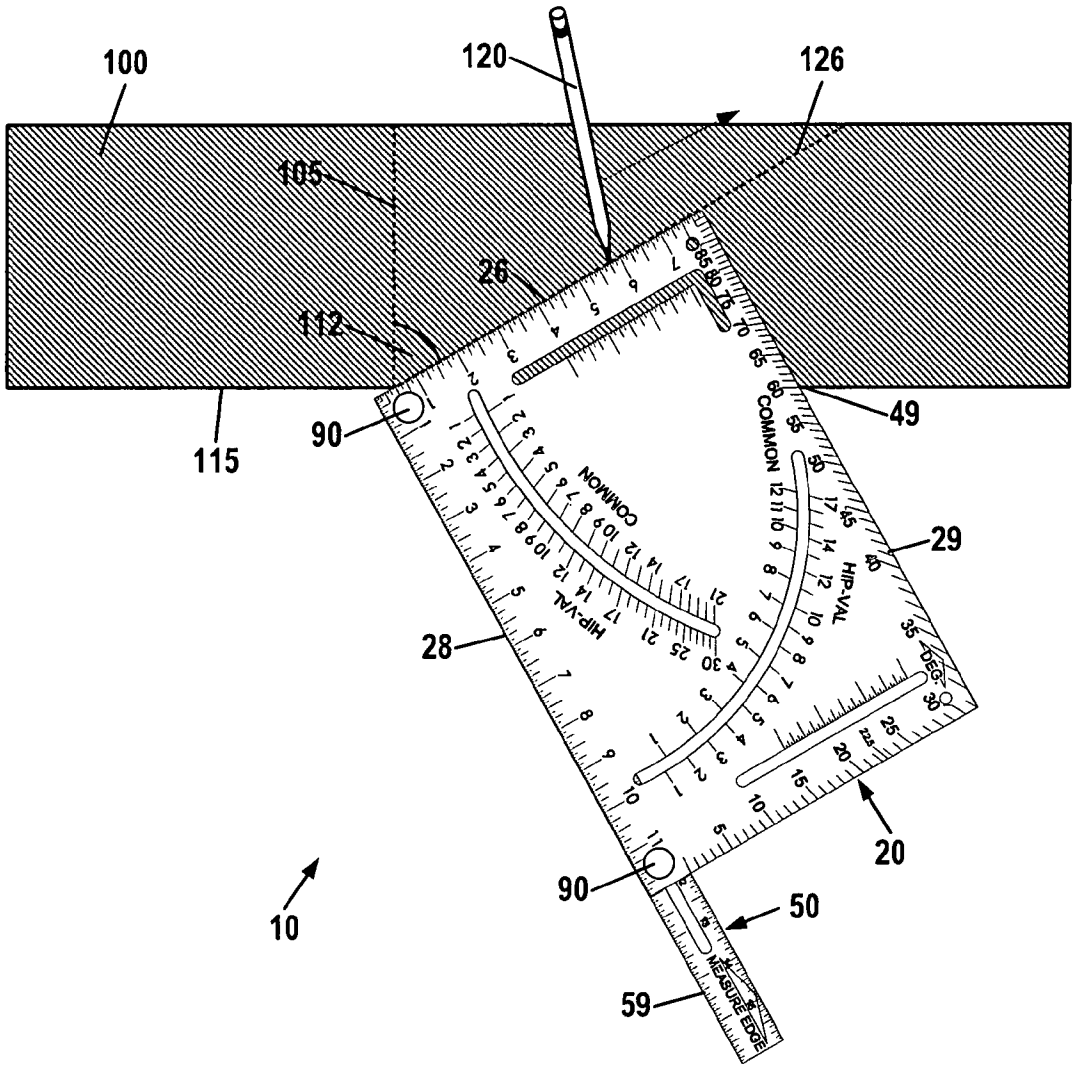
FIG. 3 illustrates the layout tool pivoted on the workpiece to mark a second cut line having an angle to the perpendicular equal to a second selected pivot angle.

FIG. 3 illustrates the layout tool 10 pivoted on the workpiece 100 to mark a second cut line 126 having an angle 112 to the perpendicular 105 equal to a second selected pivot angle 49. In FIG. 3, the layout tool 10 is positioned so that the angle markings on the distal longitudinal edge 29 of the layout tool 10, corresponding with the second selected pivot angle 49, lines up with workpiece straight edge 115.

Figure 4:
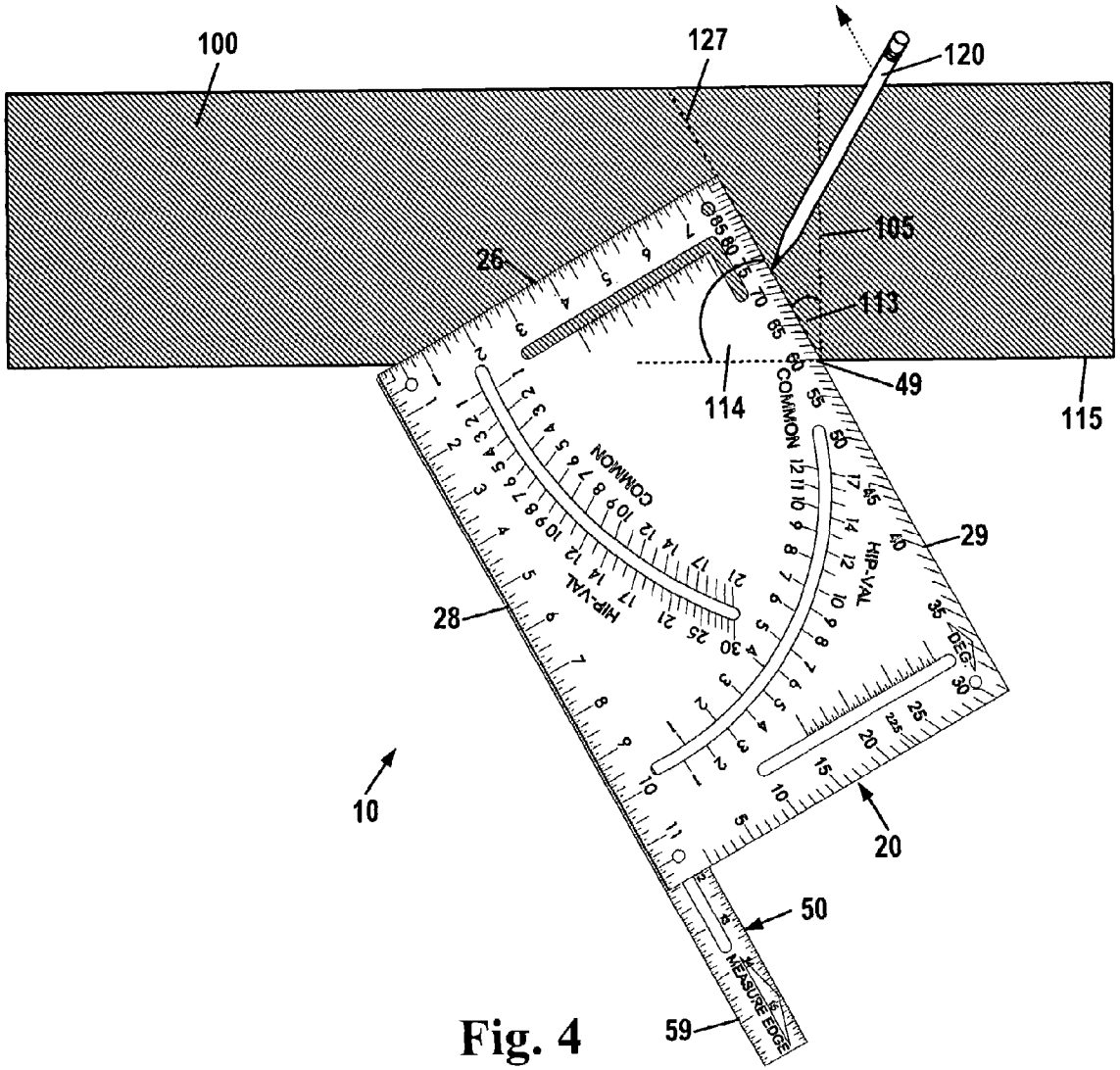
FIG. 4 illustrates the layout tool of FIG. 3 to mark a third cut line having an angle equal to 90 degrees minus the second selected pivot angle.

FIGS. 2-4 illustrate one of the significant advantages that the rectangular configuration of the base plate 20 has over prior art triangular speed squares. FIGS. 2 and 3 illustrate how the left latitudinal edge 26 of the base plate 20 provides a guide for marking a line at an angle from the workpiece perpendicular 105. FIG. 4 illustrates how the distal longitudinal edge 29 of the base plate 20 can act as another guide for marking a third cut line 127 at an angle from the workpiece straight edge 115.

The third cut line 127, unlike the first and second cut lines 125 and 126, extends at counterclockwise angle from the perpendicular 105. Because the rectangular configuration of the base plate 20 provides two guides, perpendicular to each other, for marking lines on a workpiece, the layout tool 10 facilitates the marking of cut lines from an angle of 0 to 180 degrees without the necessity of flipping the layout tool 10, as one would have to do to mark the same range of angles using a traditional triangular speed square. Eliminating the need to flip the tool 10 reduces confusion and errors and makes the process of marking and cutting lines easier, faster, and generally more accurate.

The third cut line 127 has an angle 113 to the perpendicular 105 equal to 90 degrees minus the second selected pivot angle 49. Viewed another way, the third cut line 127 has an angle 114 to the workpiece straight edge 115 that is equal to the second selected pivot angle 49.

FIGS. 2-4 also illustrate "free pivoting" configurations of the layout tool 10. In each of those drawings, the layout tool 10 is configured to be freely pivoted about the round, curved corner 54 of the locator bar 50, while the bar's longitudinal alignment edge 59 is aligned with the proximal longitudinal edge 28 of the base plate 20.

FIGS. 5 and 6, by contrast, illustrate "fixed layout angle" configurations of the layout tool 10. In FIGS. 5 and 6, the locator bar 50 is locked to the base plate 20 at a selected angular position. These configurations are designed to position the measuring edge 55 of the locator bar 50 against the workpiece straight edge 115, in order to facilitate more accurate angle markings or cuts along the distal longitudinal edge 29 and left latitudinal edge 26 of the base plate 20.

In FIG. 5, the locator bar 50 is mounted on the underside of the base plate 20 at a pivot point centered at hole 31 of the base plate 20. To configure the layout tool 10 as shown, a first shaft connector 85 is inserted, from below, through the hole 51 of the locator bar 50 and the hole 31 of the base plate 20. The locator bar 50 is then pivoted to a selected angle marking along the right latitudinal edge 27 of the base plate 20 (or alternatively to a selected slope marking 41 or 42 along the arcuate slot 37. FIG. 5 illustrates how the slot 37 exposes the measuring edge 55 to view, so that it can be aligned with the appropriate slope marking 41 or 42. A second shaft connector 85 is then inserted, from below, through the longitudinal slot 57 of the locator bar 50 and the arcuate slot 37 of the base plate 20. Finally, both shaft connectors 85 are engaged by a hand-tightened flange nut 90.

In FIG. 5, the layout tool 10 is positioned over the face of the workpiece 100, with the measuring edge 55 of the locator bar 50 positioned against the workpiece straight edge 115. While in this position, the tip of a pencil 120 is drawn against the left latitudinal edge 26 of the base plate 20 in order to draw an angle 116 from the perpendicular 105 that is either equal to the selected angle marking or that corresponds to the selected rafter slope marking.

In FIG. 6, the locator bar 50 is mounted on the underside of the base plate 20 at a second pivot point centered at hole 33 of the base plate 20. FIG. 6's fixed layout angle configuration facilitates larger angle markings than the configuration shown in FIG. 5. In FIG. 6, the locator bar 50 has been positioned for marking common rafter cuts to build a steep roof with a slope of 21 inches of rise per foot of run, or for marking hip-valley rafter cuts to build a roof with a slope of 30 inches of rise per foot of run.

To configure the layout tool 10 as shown in FIG. 6, the locator bar 50 is oriented so that its measuring edge 55 faces the distal right corner 24. A first shaft connector 85 is inserted, from below, through the hole 51 of the locator bar 50 and the hole 33 of the base plate 20. The locator bar 50 is pivoted to a selected slope marking 41 or 42 along the second arcuate slot 36. FIG. 6 illustrates how the slot 36 exposes the measuring edge 55 to view, so that it can be aligned with the appropriate slope marking 41 or 42. A second shaft connector 85 is then inserted, from below, through the longitudinal slot 57 of the locator bar 50 and the arcuate slot 36 of the base plate 20. Finally, both shaft connectors 85 are engaged by a hand-tightened flange nut 90.

In FIG. 6, the layout tool 10 is positioned over the face of the workpiece 100, with the measuring edge 55 of the locator bar 50 positioned against the workpiece straight edge 115. While in this position, the tip of a pencil 120 is moved against the distal longitudinal edge 29 of the base plate 20 in order to draw a rafter cut line at an angle 117 from the perpendicular 105 that corresponds to the selected slope marking.

FIG. 7 illustrates the layout tool 10 with its locator bar 50 configured for laying out a staircase stringer 200. As with FIG. 6, the locator bar 50 is locked to the base plate 20 at two points, one of them located at the left distal hole 33. But in contrast to FIG. 6, FIG. 7's configuration has the locator bar 50 oriented so that its measuring edge 55 faces the proximal left corner 21 of the base plate 20. A first shaft connector 85 is inserted up through the longitudinal slot 57 of the locator bar 50 and the latitudinal L-slot 38 of the base plate 20. A second shaft connector 85 is inserted up through the longitudinal slot 56 of the locator bar 50 and the arcuate slot 36 of the base plate 20. Before the corresponding flange nuts 90 are tightened, the locator bar 50 is positioned so that its measuring edge 55 intersects the appropriate "rise" and "run" length reference points of the base plate 20. Once the flange nuts 90 are tightened, the layout tool 10 is configured for laying out the staircase stringer 200.

Once the layout tool 10 is in the proper staircase stringer configuration, the tool 10 is positioned over the face of the stringer 200, with the measuring edge 55 of the locator bar 50 positioned against the straight edge 215 of the stringer 200. "Rise" and "run" pencil markings 225 and 226 are then quickly made against the left latitudinal edge 26 and the proximal longitudinal edge 28 of the base plate 20. After each set of rise and run pencil markings 225 and 226 is made, the layout tool 10 is quickly repositioned further down the stringer 200 to mark the next set of rise and run pencil markings 225 and 226.

FIGS. 8*a* through 8*d* illustrate the layout tool 10 of FIG. 7 rotated into positions for laying out the ends of the staircase stringer 200. After the rise and run cut lines 225 and 226 are marked on the stringer 200, the layout tool 10 can be used—without reconfiguration of the locator bar 50—to mark the stringer plumb cut line 227 and the stringer level cut line 228. The letters A, B, C, D, and E designate the positions and orientations of the layout tool 10 that enable these marks to be made. As a beginning reference point, position "A" illustrates the layout tool 10 being used to mark out the last "rise" line 225 of the stringer 200.

To mark the stringer cut level line 228, the layout tool 10 is simply translated from position "A" to the opposite side of the stringer 200, as illustrated in position "B," with the proximal longitudinal edge 59 of the locator bar 50 lying against the opposite edge 216 of the stringer 200. The stringer cut level line 228 is then marked against the distal longitudinal edge 29 of the base plate 20. If the cut level line 228 needs to be extended, then the layout tool 10 is rotated counterclockwise 90 degrees and moved to the right edge 217 of the stringer 200, as illustrated in position "C," with the proximal longitudinal edge 59 of the locator bar 50 lying against the right edge 217 of the stringer 200. The extension of the cut level line 228 is then marked against the right latitudinal edge 27 of the base plate 20.

To mark the stringer plumb cut line 227, the layout tool 10 is translated from position "C" to position "D," this time with the measuring edge 55 of the locator bar 50 lying against the left edge 218 of the stringer 200. Alternatively, assuming that position "C" was not needed, the layout tool 10 is rotated counterclockwise 90 degrees from the position shown in position "A" or "B" and moved toward the left edge 218 of the stringer 200. Either way, the stringer plumb cut line 227 is then marked against the proximal longitudinal edge 28 of the base plate 20. If the stringer plumb cut line 227 needs to be extended, then the layout tool 10 can be translated (without rotation) from position "B" to position "E," and the line 227 extended by marking against the right latitudinal edge 27 of the base plate 10.

FIG. 9 illustrates the layout tool 10 with its locator bar 50 configured to mark rip lines 155 parallel to the workpiece straight edge 115. Once again, the locator bar 50 is locked to the base plate 20 at two points. The locator bar 50 is oriented so that its measuring edge 55 faces the proximal longitudinal edge 28 of the base plate 20. A first shaft connector 85 is inserted up through the longitudinal slot 57 of the locator bar 50 and the latitudinal L-slot 38 of the base plate 20. A second shaft connector 85 is inserted up through the longitudinal slot 56 of the locator bar 50 and the latitudinal straight slot 39 of the base plate 20. Before the corresponding flange nuts 90 are tightened, the locator bar 50 is positioned so that its measuring edge 55 is parallel with the proximal longitudinal edge 28 of the base plate 20. The coordinated alignment markings 43 and 44 along slots 38 and 39 facilitate the parallel positioning of the locator bar 50 against the base plate 20. Once the flange nuts 90 are tightened, the layout tool 10 is configured for marking rip lines.

Once the layout tool 10 is in the proper rip-line-marking configuration, the tool 10 is positioned over the face of the workpiece 100, with the measuring edge 55 of the locator bar 50 positioned against the straight edge 115 of the workpiece 100. Rip lines 155 are easily and quickly made by moving the pencil 120 along the proximal longitudinal edge 28 of the base plate 20, or by holding the pencil 120 against the edge 28 while sliding the base plate 20 along the workpiece 100.

Figure 10:
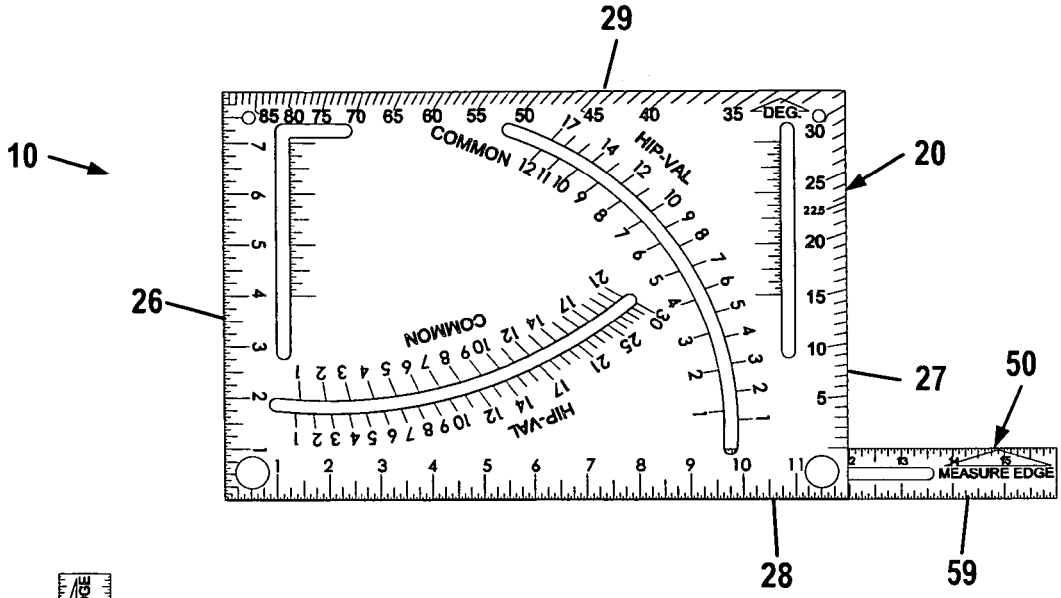
FIG. 10 illustrates the layout tool with its locator bar configured to form an 8-inch by 16-inch framing square.
Figure 11:
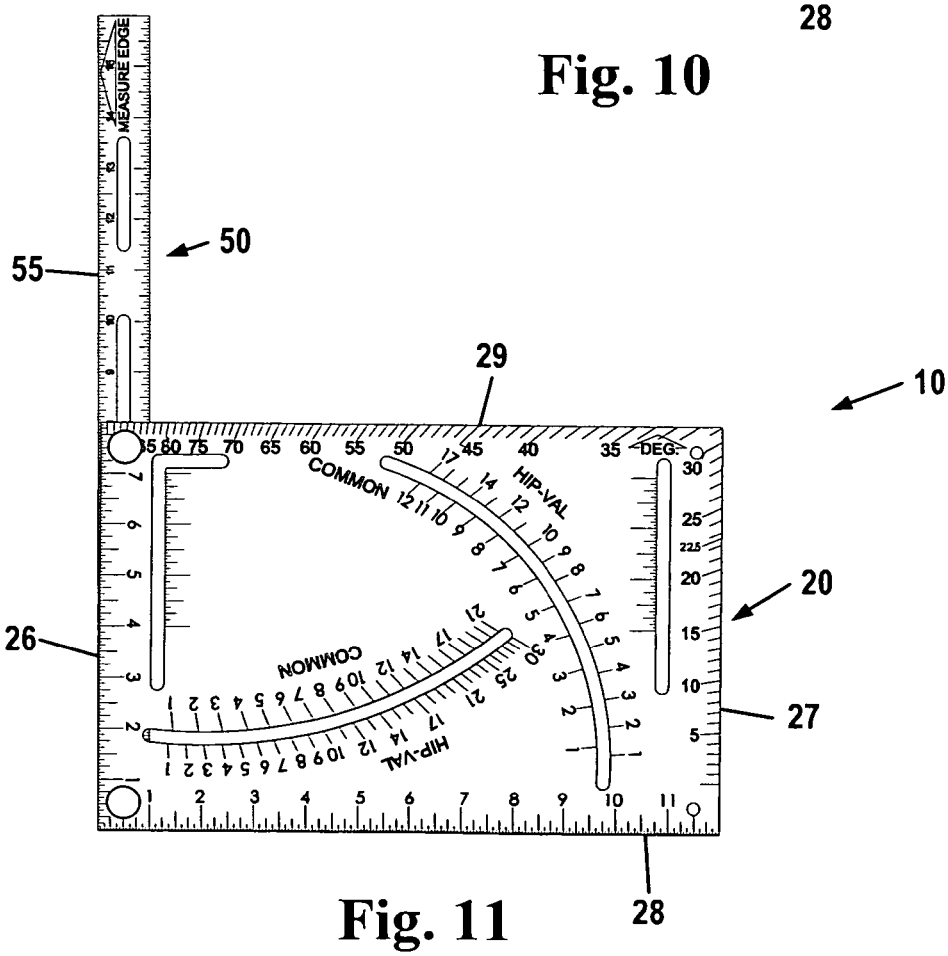
FIG. 11 illustrates the layout tool with its locator bar configured to form a 12-inch by 16-inch framing square.

The layout tool 10 can also be configured as two differently-dimensioned right-angle framing tools (often referred to in the art as a "framing square"). FIG. 10 illustrates the layout tool 10 with its locator bar 50 configured to form an 8-inch by 16-inch framing square. The configuration is identical to that shown in FIGS. 2-4, with the alignment edge 59 of the locator bar 50 aligned with the base plate's proximal longitudinal edge 28. FIG. 11 illustrates the layout tool 10 with its locator bar 50 configured to form a 12-inch by 16-inch framing square. Here, the locator bar 50 is connected to the base plate 20 at hole 31 by connector 85 and pivoted until its measuring edge 55 is aligned with the base plate's left latitudinal edge 26. In the 12-inch by 16-inch configuration, in particular, the layout tool 10 facilitates the rapid laying out of the center points of studs that are to be separated either 12 or 16 inches apart.

Although not shown in the drawings, the locator bar 50 can be removed and separated from the base plate 20 and used as a gauge.

Although the foregoing specific details describe various embodiments of the invention, persons reasonably skilled in the art will recognize that various changes may be made in the details of the apparatus or method of this invention without departing from the spirit and scope of the invention as defined in the appended claims.

The present invention includes several independently meritorious inventive aspects and advantages. Unless compelled by the claim language itself, the claims should not be construed to be limited to structures that incorporate all of the inventive aspects, or enjoy all of the advantages, disclosed herein.

It is well established that the claims of the patent serve an important public notice function to potential competitors—enabling them to not only determine what is covered, but also what is not covered—by the patent. And a number of Federal Circuit decisions have emphasized the importance of discerning the patentee's intent—as expressed in the specification—in construing the claims of the patent.

It is my intent that the claims receive a liberal construction and be interpreted to uphold and not destroy the right of the inventor. It is my intent that the claim terms be construed in a charitable and common-sensical manner, in a manner that encompasses the embodiments disclosed in the specification and drawings without incorporating unrecited, unnecessary limitations. It is my intent that the claim terms be construed as broadly as practicable while preserving the validity of the claims. It is my intent that the claim terms be construed in a manner consistent with the context of the overall claim language and the specification, without importing extraneous limitations from the specification or other sources into the claims, and without confining the scope of the claims to the exact representations depicted in the specification or drawings. It is also my intent that not each and every term of the claim be systematically defined and rewritten. Claim terms and phrases should be construed only to the extent that it will provide helpful, clarifying guidance to the jury, or to the extent needed to resolve a legitimate, good faith dispute that is material to the questions of validity or infringement. Otherwise, simple claim terms and phrases should be presented to the jury without any potentially confusing and difficult-to-apply definitional construction.

It is also to be understood that the terminology employed in the Summary of the Invention and Detailed Description sections of this application is for the purpose of describing particular embodiments. Unless the context clearly demonstrates otherwise, is not intended to be limiting. In this specification and the appended claims, the singular forms "a," "an" and "the" include plural references unless the context clearly dictates otherwise. Conversely, it is contemplated that the claims may be drafted to exclude any optional element or be further limited using exclusive terminology as "solely," "only" and the like in connection with the recitation of claim elements or by use of a "negative" limitation. It is also contemplated that any optional feature of the inventive variations described herein may be set forth and claimed independently, or in combination with any one or more of the features described herein.

The headquarters building of the World Intellectual Property Organization bears the following inscription: "Human genius is the source of all works of art and invention; these works are the guarantee of a life worthy of me; it is the duty of the State to ensure with diligence the protection of the arts and inventions." It is my intent that the claims of this patent be construed—and ultimately enforced, if necessary—in a manner worthy of this mandate.

I claim:

1. A multi-purpose layout tool comprising:

a rectangular base plate having:

four right-angle corners, first and second longitudinal edges, and first and second latitudinal edges;

a pivot point located near one of the four right-angle corners;

an elongated arcuate slot having common rafter slope markings and hip-valley rafter slope markings;

a locator bar having a straight measuring edge operable to be aligned with the markings of the arcuate slot and laid against a straight edge of a workpiece, the locator bar having a first end operable to be pivotally and removably attached to the base plate at the pivot point, the locator bar being longer than any of the edges of the base plate and of sufficient length when pivotally attached at the pivot point to intersect the base plate's arcuate slot at a selectable intersection point;

a first connector operable to connect the locator bar to the base plate at the pivot point;

wherein the locator bar is operable to be pivoted about the pivot point between a position that aligns the bar's proximal longitudinal edge with the base plate's first longitudinal edge to a position that aligns the bar's layout edge with the base plate's first latitudinal edge;

whereby the layout tool is operable to be configured as two differently-dimensioned right-angle framing tools; and a second connector operable to connect the locator bar to the base plate through the selectable intersection point at an angle with respect to the first longitudinal edge of the base plate;

whereby when the locator bar is secured to the base plate at an angle with respect to the first longitudinal edge and laid against a workpiece straight edge, the first latitudinal edge of the base plate provides a guide for marking a line or moving a saw at an angle corresponding to a selected one of the rafter slope markings of the arcuate slot.

2. The layout tool of claim 1, further comprising regularly-spaced distance markings inscribed adjacent the first longitudinal edge and adjacent the first latitudinal edge of the base plate, thereby facilitating a layout of a staircase stringer.

3. The layout tool of claim 1, wherein the rectangular base plate is planar and lipless.

4. The layout tool of claim 1, wherein the pivot point is located near the intersection of the first longitudinal edge with the first latitudinal edge and the elongated arcuate slot is concave with respect to the pivot point.

5. The layout tool of claim 1, wherein regularly-spaced distance markings are inscribed adjacent the first longitudinal edge and adjacent the first latitudinal edge on both sides of the base plate.

6. The multi-purpose layout tool of claim 1, wherein the base plate has dimensions of 8 by 12 inches, and the locator bar is 16 inches long;

whereby the layout tool is operable to be configured either as an 8-inch by 16-inch right-angle framing tool or as a 12-inch by 16-inch right-angle framing tool; and whereby the layout tool also facilitates rapid laying out of studs that are to be separated either 12 or 16 inches apart.

7. The multi-purpose layout tool of claim 1, further comprising:

angle markings inscribed adjacent the second longitudinal edge of the base plate; and angle markings inscribed adjacent the second latitudinal edge of the base plate.

8. A multi-purpose layout tool comprising:

a rectangular base plate having:

four right-angle corners, first and second longitudinal edges, and first and second latitudinal edges;

regularly-spaced distance markings inscribed adjacent the first longitudinal edge and adjacent the first latitudinal edge of the base plate, thereby facilitating a layout of a staircase stringer;

a pivot point located near one of the four right-angle corners;

an elongated arcuate slot having common rafter slope markings and hip-valley rafter slope markings;

a second slot adjacent the first latitudinal edge of the base plate;

a third slot adjacent the first longitudinal edge of the base plate;

a locator bar having a straight measuring edge operable to be aligned with the markings of the arcuate slot and laid against a straight edge of a workpiece, the locator bar having a first end operable to be pivotally and removably attached to the base plate at the pivot point, the locator bar being of sufficient length when pivotally attached at the pivot point to intersect the base plate's arcuate slot at a selectable intersection point;

a first connector operable to connect the locator bar to the base plate at the pivot point; and a second connector operable to connect the locator bar to the base plate through the selectable intersection point;

whereby when the locator bar is laid against a workpiece straight edge, the first latitudinal edge of the base plate provides a guide for marking a line or moving a saw at an angle corresponding to a selected one of the rafter slope markings of the arcuate slot; and wherein the first and second connectors are also operable to secure the locator bar to the base plate through the second and third slots in order to position the locator bar's measuring edge to intersect both a selected rise length reference point along the first latitudinal edge of the base plate and a selected run length reference along the first longitudinal edge of the base plate so that its measuring edge intersects the base plate along the selected rise and run length reference points.

9. A multi-purpose layout tool comprising:

a rectangular base plate having:

four right-angle corners, first and second longitudinal edges, and first and second latitudinal edges;

a pivot point located near one of the four right-angle corners;

an elongated arcuate slot having common rafter slope markings and hip-valley rafter slope markings;

a second slot adjacent the first latitudinal edge of the base plate;

a third slot adjacent the second latitudinal edge of the base plate;

coordinated markings adjacent the second and third slots;

a locator bar having a straight measuring edge operable to be aligned with the markings of the arcuate slot and laid against a straight edge of a workpiece, the locator bar having a first end operable to be pivotally and removably attached to the base plate at the pivot point, the locator bar being of sufficient length when pivotally attached at the pivot point to intersect the base plate's arcuate slot at a selectable intersection point;

a first connector operable to connect the locator bar to the base plate at the pivot point; and a second connector operable to connect the locator bar to the base plate through the selectable intersection point;

whereby when the locator bar is laid against a workpiece straight edge, the first latitudinal edge of the base plate provides a guide for marking a line or moving a saw at an angle corresponding to a selected one of the rafter slope markings of the arcuate slot;

wherein the first and second connectors are also operable to secure the locator bar to the base plate through the second and third slots; and wherein the coordinated markings adjacent the second and third slots facilitate a parallel positioning of the locator bar's measuring edge to the longitudinal edges of the base plate;

whereby when the locator bar is secured parallel to the longitudinal edges of the base plate and laid against a workpiece straight edge, the longitudinal edges of the base plate provide a guide for marking a rip line parallel to the workpiece straight edge.

10. A multi-purpose layout tool comprising:

a rectangular base plate having:

four right-angle corners, first and second longitudinal edges, and first and second latitudinal edges;

a first pivot point located near one of the four right-angle corners, near the intersection of the first longitudinal edge with the first latitudinal edge;

a first elongated arcuate slot having common rafter slope markings and hip-valley rafter slope markings, wherein the first elongated arcuate slot is concave with respect to the first pivot point;

a second pivot point on the base plate located near the intersection of the second longitudinal edge with the first latitudinal edge;

a second elongated arcuate slot on the base plate that is concave with respect to the second pivot point, the second elongated arcuate slot also having common rafter slope markings and hip-valley rafter slope markings;

a locator bar having a straight measuring edge operable to be aligned with the markings of the first arcuate slot and laid against a straight edge of a workpiece, the locator bar having a first end operable to be pivotally and removably attached to the base plate at the first pivot point, the locator bar being of sufficient length when pivotally attached at the pivot point to intersect the base plate's first arcuate slot at a selectable intersection point;

a first connector operable to connect the locator bar to the base plate at the first pivot point; and a second connector operable to connect the locator bar to the base plate through the selectable intersection point;

whereby when the locator bar is laid against a workpiece straight edge, the first latitudinal edge of the base plate provides a guide for marking a line or moving a saw at an angle corresponding to a selected one of the rafter slope markings of the first arcuate slot;

the locator bar also being operable to be pivotally and removably attached to the base plate at the second pivot point and to be aligned with the markings of the second elongated arcuate slot;

wherein the second elongated arcuate slot facilitates a range of locked angular orientations of the locator bar with respect to the base plate that span more than 45 degrees.

11. A multi-purpose layout tool comprising:

a rectangular base plate having:

four right-angle corners, first and second longitudinal edges, and first and second latitudinal edges;

angle markings inscribed adjacent the second longitudinal edge of the base plate;

angle markings inscribed adjacent the second latitudinal edge of the base plate;

a pivot point located near one of the four right-angle corners;

an elongated arcuate slot having common rafter slope markings and hip-valley rafter slope markings;

a locator bar having a straight measuring edge operable to be aligned with the markings of the arcuate slot and laid against a straight edge of a workpiece, the locator bar having a first end operable to be pivotally and removably attached to the base plate at the pivot point, the locator bar being of sufficient length when pivotally attached at the pivot point to intersect the base plate's arcuate slot at a selectable intersection point;

a first connector operable to connect the locator bar to the base plate at the pivot point; and a second connector operable to connect the locator bar to the base plate through the selectable intersection point;

whereby when the locator bar is laid against a workpiece straight edge, the first latitudinal edge of the base plate provides a guide for marking a line or moving a saw at an angle corresponding to a selected one of the rafter slope markings of the arcuate slot.

12. The layout tool of claim 11, wherein regularly-spaced distance markings are inscribed adjacent the first longitudinal edge and adjacent the first latitudinal edge on both sides of the base plate; and wherein angle markings are inscribed adjacent the second longitudinal edge and adjacent the second latitudinal edge on both sides of the base plate.

13. A multi-purpose layout tool comprising:

a rectangular base plate with an elongated arcuate slot that is concave with respect to a proximal corner of the base plate;

the slot having common rafter slope markings;

regularly-spaced distance markings inscribed adjacent the first longitudinal edge and adjacent the first latitudinal edge of the base plate; and an elongate bar operable to be removably secured to the base plate in a manner that aligns a proximal longitudinal edge of the base plate with a longitudinal alignment edge of the elongate bar and that also aligns a latitudinal alignment edge of the bar with a first latitudinal edge of the base plate;

the elongate bar having a layout edge opposite from and parallel to the bar's longitudinal alignment edge;

additional regularly-spaced distance markings inscribed on the elongate bar;

wherein the elongate bar is longer than the proximal longitudinal edges of the base plate and the proximal longitudinal edge of the base plate is longer than the first latitudinal edge of the base plate;

wherein the elongate bar is operable to be pivoted about a pivot point adjacent the proximal corner of the base plate between a position that aligns the bar's proximal longitudinal edge with the base plate's proximal longitudinal edge to a position that aligns the bar's layout edge with the base plate's latitudinal edge;

whereby the layout tool is operable to be configured as two differently-dimensioned right-angle framing tools;

the elongate bar also having a curved corner to intersect the bar's layout edge with its latitudinal alignment edge;

the curved corner providing a pivot surface for pivoting the layout tool; and the curved corner having a radius dimensioned so that when the bar, while being secured to the base plate in a manner that aligns the base plate's proximal longitudinal edge with the bar's longitudinal alignment edge, is laid out against a workpiece straight edge and then pivoted about the curved corner, the workpiece straight edge is operable to intersect a slot marking that approximately represents the slope, in inches over feet, of an angle between the workpiece straight edge and the base plate's proximal longitudinal edge.

14. The multi-purpose layout tool of claim 13, further comprising:

angle markings extending substantially between zero and ninety degrees starting near a second proximal corner of the base plate, extending along a second latitudinal edge of the base plate, continuing along a distal longitudinal edge of the base plate, and terminating near a distal corner of the base plate opposite the second proximal corner;

wherein the first latitudinal edge of the base plate, when the tool is laid out against a workpiece straight edge and then pivoted about the layout bar's curved corner, provides a guide for marking a line at an angle from a line perpendicular to the workpiece straight edge that corresponds to an angle marking intersecting the workpiece straight edge; and wherein a distal longitudinal edge of the base plate, when the tool is laid out against a workpiece straight edge and then pivoted about the layout bar's curved corner, provides a guide for marking a line at an angle from the workpiece straight edge that corresponds to an angle marking intersecting the workpiece straight edge.

15. The multi-purpose layout tool of claim 13, wherein the base plate has dimensions of 8 by 12 inches, and the locator bar is 16 inches long;

whereby the layout tool is operable to be configured either as an 8-inch by 16-inch right-angle framing tool or as a 12-inch by 16-inch right-angle framing tool; and whereby the layout tool also facilitates rapid laying out of studs that are to be separated either 12 or 16 inches apart.

16. The multi-purpose layout tool of claim 13, further comprising:

a measuring edge on the elongate bar opposite the proximal alignment edge of the elongate bar;

first and second connectors for securing the elongate bar to the base plate;

wherein the elongate bar is operable to be pivoted from a first position in which the bar's longitudinal alignment edge is aligned with the base plate's proximal longitudinal edge, to a second position in which the elongate bar's measuring edge is aligned with one of the common rafter slope markings on the base plate's elongated arcuate slot; and wherein the first and second connectors are operable to secure the elongate to the base plate at the second position.

17. A multi-purpose layout tool comprising:

a locator bar having a layout edge;

a rectangular base plate having:

four right-angle corners, first and second longitudinal edges, and first and second latitudinal edges;

regularly-spaced distance markings inscribed adjacent the first longitudinal edge and adjacent the first latitudinal edge to facilitate a layout of a staircase stringer;

a first slot adjacent the first latitudinal edge of the base plate for positioning the locator bar's layout edge to intersect a selected rise length reference point along the first latitudinal edge of the base plate; and a second slot adjacent the first longitudinal edge of the base plate for positioning the locator bar's layout edge to intersect a selected run length reference point along the first longitudinal edge of the base plate;

wherein the second slot is a curved arcuate slot with common rafter slope markings and hip-valley rafter slope markings, whereby the second slot serves not only a purpose of securing the locator bar to the base plate at selected rise and run length reference points, but also an alternate purpose of securing the locator bar in a position for marking rafter cut lines or making rafter cuts;

first and second connectors operable to secure the locator bar to the base plate through the first and second slots so that its layout edge intersects the base plate along the selected rise and run length reference points;

whereby when the locator bar is laid against a straight edge of a workpiece to be shaped into a staircase stringer, the first longitudinal edge and first latitudinal edge of the base plate provide a guide for marking staircase stringer cut lines; and whereby when the layout tool is repositioned, without adjusting its angular orientation, on an opposite straight edge of the workpiece, the second latitudinal edge provides a guide for marking a staircase stringer plumb cut line, and the second longitudinal edge provides a guide for marking a stringer level cut line.

18. A multi-purpose layout tool comprising:

a locator bar having a layout edge;

a rectangular base plate having:

four right-angle corners, first and second longitudinal edges, and first and second latitudinal edges;

regularly-spaced distance markings inscribed adjacent the first longitudinal edge and adjacent the first latitudinal edge to facilitate a layout of a staircase stringer;

a first slot adjacent the first latitudinal edge of the base plate for positioning the locator bar's layout edge to intersect a selected rise length reference point along the first latitudinal edge of the base plate; and a second slot adjacent the first longitudinal edge of the base plate for positioning the locator bar's layout edge to intersect a selected run length reference point along the first longitudinal edge of the base plate;

a third slot adjacent a second latitudinal edge of the base plate opposite the first latitudinal base edge; and coordinated markings adjacent the first and third slots that facilitate a parallel positioning of the locator bar to the longitudinal edges of the base plate;

whereby the first slot serves not only a purpose of securing the locator bar to the base plate at selected rise and run length reference points, but also a purpose of securing the locator bar in a position for marking rip cut lines or making rip cuts;

first and second connectors operable to secure the locator bar to the base plate through the first and second slots so that its layout edge intersects the base plate along the selected rise and run length reference points;

whereby when the locator bar is laid against a straight edge of a workpiece to be shaped into a staircase stringer, the first longitudinal edge and first latitudinal edge of the base plate provide a guide for marking staircase stringer cut lines; and whereby when the layout tool is repositioned, without adjusting its angular orientation, on an opposite straight edge of the workpiece, the second latitudinal edge provides a guide for marking a staircase stringer plumb cut line, and the second longitudinal edge provides a guide for marking a stringer level cut line.

19. A multi-purpose layout tool comprising:

a locator bar having a layout edge;

a rounded corner on the locator bar providing a pivot edge for pivoting the locator bar against a workpiece straight edge;

a longitudinal alignment edge on the locator bar opposite the locator bar's layout edge;

a rectangular base plate having:

four right-angle corners, first and second longitudinal edges, and first and second latitudinal edges;

regularly-spaced distance markings inscribed adjacent the first longitudinal edge and adjacent the first latitudinal edge to facilitate a layout of a staircase stringer;

angle markings inscribed adjacent the second longitudinal edge of the base plate;

angle markings inscribed adjacent the second latitudinal edge of the base plate;

a pivot hole located near the corner adjacent the first longitudinal and first latitudinal edges of the base plate;

a first slot adjacent the first latitudinal edge of the base plate for positioning the locator bar's layout edge to intersect a selected rise length reference point along the first latitudinal edge of the base plate; and a second slot adjacent the first longitudinal edge of the base plate for positioning the locator bar's layout edge to intersect a selected run length reference point along the first longitudinal edge of the base plate;

first and second connectors operable to secure the locator bar to the base plate through the first and second slots so that its layout edge intersects the base plate along the selected rise and run length reference points;

whereby when the locator bar is laid against a straight edge of a workpiece to be shaped into a staircase stringer, the first longitudinal edge and first latitudinal edge of the base plate provide a guide for marking staircase stringer cut lines; and whereby when the layout tool is repositioned, without adjusting its angular orientation, on an opposite straight edge of the workpiece, the second latitudinal edge provides a guide for marking a staircase stringer plumb cut line, and the second longitudinal edge provides a guide for marking a stringer level cut line;

wherein the first connector is also operable to secure the locator bar to the base plate through the base plate's pivot hole;

wherein the second connector is also operable to secure the locator bar to the base plate in a manner that aligns the base plate's first longitudinal edge with the bar's longitudinal alignment edge so that when the bar's layout edge is laid out against a workpiece straight edge and then pivoted about the curved corner, the workpiece straight edge intersects an angle marking that represents an angle between the workpiece straight edge and the base plate's first longitudinal edge.

20. The multi-purpose layout tool of claim 19, further comprising:

an elongated arcuate slot opposite to and concave with respect to the pivot hole of the base plate;

the elongated arcuate slot having common rafter slope markings and hip-valley rafter slope markings;

wherein the second connector is operable to secure the locator bar to the base plate in a manner that aligns the locator bar's layout edge with a rafter slope marking on the elongated arcuate slot so that when the bar's layout edge is laid against a workpiece straight edge, the first latitudinal edge of the base plate provides a guide for marking a line or moving a saw at an angle corresponding to the rafter slope markings of the elongated arcuate slot.

* * * * *